United States Patent [19]

Kenworthy

[11] 4,132,354

[45] Jan. 2, 1979

[54] AUXILIARY AIR DISPLACEMENT METHOD AND UNIT FOR FURNACES

[76] Inventor: Clarence J. Kenworthy, 2706 E. Washington St., Des Moines, Iowa 50317

[21] Appl. No.: 822,255

[22] Filed: Aug. 5, 1977

[51] Int. Cl.[2] ..... F23N 3/00

[52] U.S. Cl. ..... 236/11; 98/39; 236/38

[58] Field of Search ..... 98/39, 400; 236/38, 236/46 E, 11, 9 A, DIG. 9; 237/55; 165/DIG. 2; 126/110 E

[56] References Cited

U.S. PATENT DOCUMENTS 2,593,759 4/1952 Horn ..... 126/110

*Primary Examiner*—William E. Wayner

*Attorney, Agent, or Firm*—Zarley, McKee, Thomte, Voorhees & Sease

[57] ABSTRACT

A method of maximizing available but unused heated air located in the plenum of a furnace which comprises sensing the point at which air within the furnace plenum is sufficiently warm to provide valuable hot air but is still below the activation temperature of the furnace blower and displacing said warmed air into the air flow paths for a room air space, and continuing said displacement after the furnace blower has shut down until the air within the plenum reaches the point at which it no longer has valuable heating capacity. The device is a heat sensitive thermostatically controlled unit which comprises a small horsepower, low energy consumption air displacement motor. Associated therewith is an air deflector for directing displaced air into the air paths for a room air space and also associated therewith is an air temperature sensing switching means for stopping and starting the motor in response to sensed temperatures within the plenum of a furnace.

10 Claims, 6 Drawing Figures

AUXILIARY AIR DISPLACEMENT METHOD AND UNIT FOR FURNACES

BACKGROUND OF THE INVENTION

Most common heating devices used currently in this country is a gas burning forced air furnace. Such a furnace, as is well known, uses a gas burner, a plenum or heat chamber into which the heated gas passes, a forced air blower, typically having from one-half horsepower up to one horsepower, and of course, associated temperature sensitive switches for on-off switching of the burner and the forced air blower in response to temperatures within the plenum, or furnace heating chamber, the two terms being used interchangeably herein, and the temperature in the associated room air space.

The operation of this conventional unit is well known but will be briefly described herein. Typically the associated temperature sensitive switch responsive to the air temperature in the plenum chamber is set to actuate at from 180° F. to 200° F. It is set at this temperature, which of course is considerably higher than the room temperature, because the warmed air within the plenum chamber must at least be this hot or else the large forced air blower will immediately cool it upon its operation, thereby decreasing the heating value of the warmed air. As a result, the forced air blower does not start until the air within the plenum chamber is much, much hotter than the desired room temperature. Likewise, the temperature sensed for shut-off of the forced air blower is also considerably higher than the desired room temperature in order that the forced air blower shuts off before the air within the plenum chamber cools to the point at which continual forcing of the air into the home air flow paths causes cooling. Typical blower activation and shut-off temperatures are from 180° F. to 200° F.

The result of this operation is that there is considerable warmed air in the plenum chamber available for displacement in to the room air space before the forced air blower comes on and there is also much available warmed air remaining in the plenum chamber and the duct work after the forced air blower shuts off. This warmed air is currently not being utilized and as a result, considerable energy is wasted.

Another disadvantage of operation of the present system is that it provides for continually fluctuating room temperatures. Say, for example, the room thermostat is set at 70° F., but the room has actually cooled to 66° to 67° F. The room thermostat actuates the burner which will require generally at least two minutes or more to heat to the 180° F. to 200° F. plenum temperature at which the large furnace blower is activated. Meanwhile, the room temperature will drop an additional one to two degrees, i.e., 65° to 66° F. When it is activated, the forced air blower forces hot air from the plenum pushing the hot air through the duct work into the room air space. When the room temperature reaches 72° to 73° F. the burner shuts off. However, air within the plenum chamber is still above the 180° F. activation temperature for the forced air blower which will continue to operate, usually sending the room temperature up to 75° to 76° F. before it shuts off. Thus, as can be seen, there are extremes in room temperature from a low of about 65° F. to a high of as much as 75° to 76° F.

The reason for this room temperature variance is, of necessity, the fact that the large forced air blower for the furnace is set for on-off operation at a temperature typically within the range of 180° F. to 200° F.

Accordingly, it is an object of the present invention to provide a method whereby the warmed air present in the plenum chamber of a gas burning forced air furnace which is hotter than the room temperature but lower than the forced air blower activation temperature, will be maximized and used before the forced air blower turns on, and wherein the warmed air in the plenum chamber after the air blower shuts off will still be utilized until it no longer has significant heat value in comparison with the desired set temperature for a room thermostat.

Accordingly, it is another object of this invention to provide a method and apparatus which allows for use of utilized warm, hot air trapped in the plenum chamber of a furnace which is otherwise wasted, thereby increasing fuel efficiency and in addition, allowing for more constant room temperature control.

The method of accomplishing these and other objects of the invention will become apparent from the following detailed description of the invention.

DETAILED DESCRIPTION OF THE INVENTION

Figure 1:
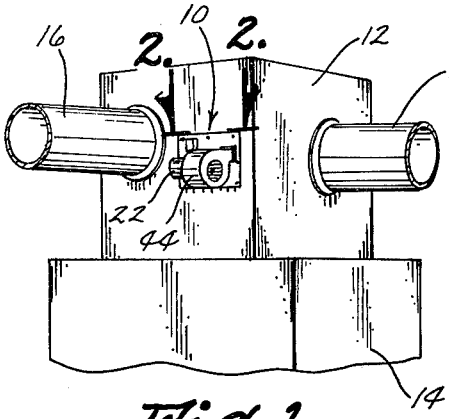
FIG. 1 is a perspective view of the auxiliary air displacement unit attached to the plenum, or heat chamber, of a forced air furnace.
Figure 2:
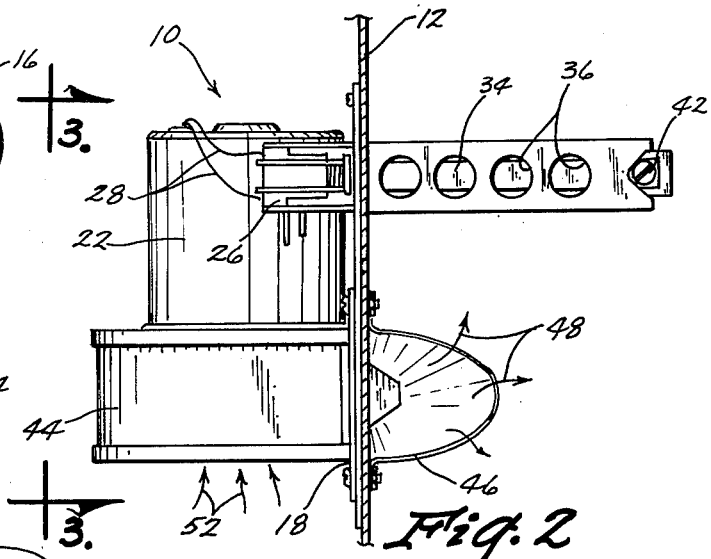
FIG. 2 is a sectional view along line 2—2 of FIG. 1.
Figure 3:
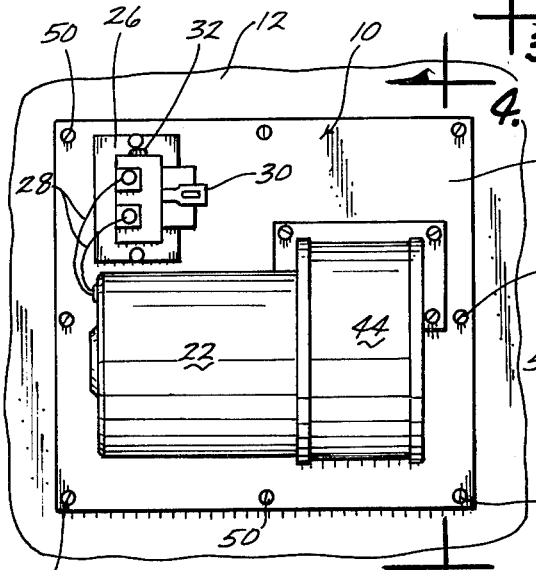
FIG. 3 is a view of the auxiliary air displacement unit along line 3—3 of FIG. 2.
Figure 4:
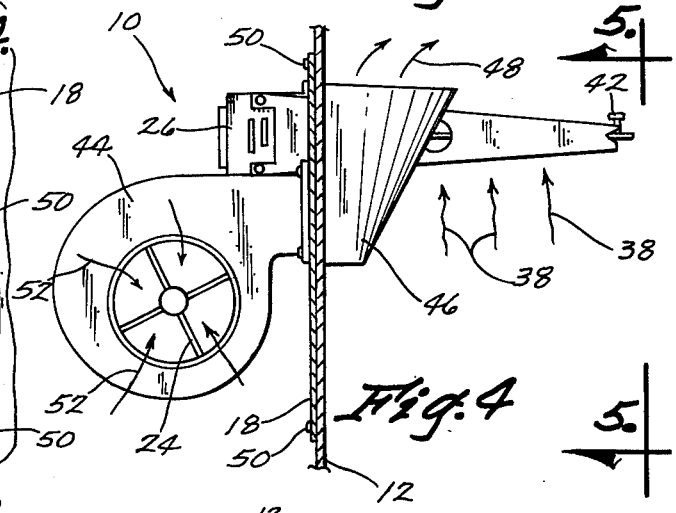
FIG. 4 is an elevated side view of the unit as it is attached to a furnace along line 4—4 of FIG. 3.
Figure 5:
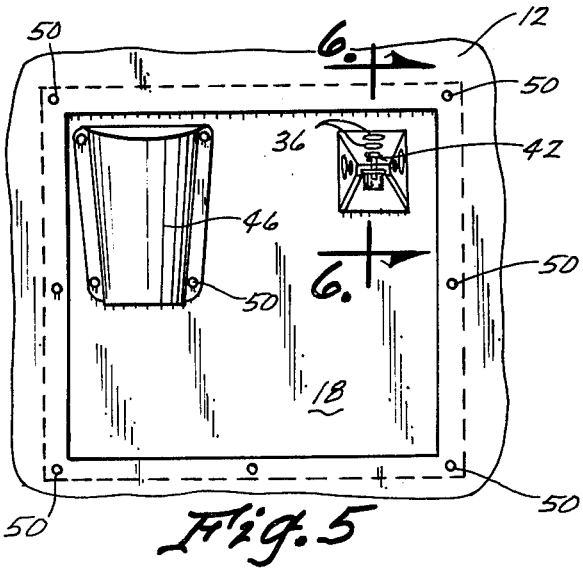
FIG. 5 is a view of the back side of the unit showing those portions which extend into the plenum chamber of a furnace.

Looking first at FIG. 1, as can be seen, the auxiliary air displacement unit, referred to generally as 10, is mounted to the plenum chamber 12 of a conventional gas burning forced air furnace 14. Plenum chamber has in communication therewith ducts 16 which carry warmed air along air paths to the room air space. The auxiliary air displacement unit 10 has a mounting plate 18 for attachment via fastening screws 20 or the like to the plenum chamber 12. Mounted on plate 18 is an auxiliary air displacement motor 22 of conventional construction. The air displacement motor 22 will not be described in detail, but is of conventional construction, and is comprised of an electric motor and an associated fan as most clearly depicted in FIG. 4.

It is most important to this invention that the electrically actuated air displacement motor and associated fan be a small horsepower device. Typically, satisfactory motors used are those having a 1/45th horsepower to a 1/50th horsepower motor and an associated small air displacement fan. Such motors are of common construction and can conveniently be obtained from Dayton Company. It is important that this unit be a small horsepower unit in order that it not move large amounts of cold forced air through the plenum chamber, thereby providing the same disadvantage as the large forced air blower associated with the furnace. The relationship between the auxiliary displacement motor and fan unit and the forced air blower for the furnace typically should be, in terms of horsepower, a maximum of 1/10th as great as the horsepower of the forced air blower, and typically 1/45th to 1/50th as much as the forced air blower.

Also mounted to plate 18 is a temperature sensitive fan control switch 26. Control switch 26 is of conventional construction and will not therefore be described in detail herein. However, as can be seen, it is electrically associated through wires 28 with motor 22. Fan control switch 26 is set via temperature adjusting lever 30 for the desired starting temperature and via dial 32 for the desired off temperature. It is desirable that the auxiliary air displacement unit 10 be set for activation when the air within the plenum chamber 12 is within a temperature range of 105° F. to 150° F. and for off at temperatures as low as 70° F. but more typically at an off setting of 80° F.

Figure 6:
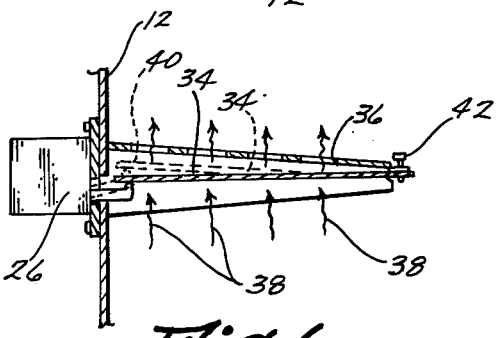
FIG. 6 is an elevated side view of the air temperature sensing switch for the displacement motor.

The fan control switch 26 employs a bimetallic strip 34 which extends into the plenum chamber. Bimetallic strip 34 is protected by perforated frame structure 36 extending therearound as depicted in FIG. 6. Warmed air is represented by arrow 38, hits bimetallic strips 36, causing it to expand, moving it upward to the position depicted at 40 which electrically energizes motor 22 causing it to run. When the temperature within the plenum chamber 12 cools, the bimetallic strip 34 contracts, causing it to move backward to its normal position, as depicted in FIG. 6, causing motor 22 to shut down.

Bimetallic strip 34 is mounted inside of frame 36 by set screw 42.

Associated with motor 22, as earlier depicted, is fan 24 located within housing 44. The air flow portion of housing 44 is in communication with air deflector 46 mounted to the back side of plate 18 and like bimetallic strip 34 extends into the interior of plenum chamber 12. The air deflector 18 may be of any conventional configuration, but is designed to direct displaced air upwardly into duct work 16 as depicted via arrows 48 in FIG. 4. Upward air deflector 46 can be mounted to the rear side of plate 18 by conventional means such as rivets 50 or other conventional fastening means.

In actual operation, the device and the method of this invention operates as follows: Again, assuming that thermostat for a room is set at 70° F., and assume that lever 34 of fan control switch is set for temperature activation of motor 22 at 105° F., and for shut off at 80° F. We will further assume that the forced air blower is set for on activation at 180° F. and off activation likewise at cooling to 180° F. When the room temperature cools to for example, 66° F. to 67° F., the thermostat senses this and the burner of the furnace goes on. However, as heretofore explained because of the large horsepower and amount of forced air necessarily used by the forced air blower it will not activate until the temperature of 180° F. in order to prevent blowing of cooled air into the rooms. However, the auxiliary air displacement unit 10 via bimetallic strip 34, senses the attainment of a temperature of 105° F. within plenum chamber 12. Fan control switch 26 is activated and actuates motor 22. The fan 24 operates and the warmed air within plenum chamber 12, along with a small amount of air moved into the fan housing 44, as depicted by arrows 52, is displaced upwardly through air deflector 46 as depicted by arrow 48 out of the plenum chamber into the air flow duct work 16. This gradual displacement of the warmed air continues causing immediate temperature rise in the room. When the air within the plenum chamber reaches 180° F., the forced air blower comes on forcing the very hot air into the duct work and of course, into the associated room space. However, the burner and forced air blower will not need to operate as long, thereby saving fuel expense, because there has been pre-warming of the air space by the more moderately heated air displaced into the room space as a result of operation of the device of this invention.

When the gas burner shuts off after the room has reached the desired 70° F., the blower continues to run until the air within plenum chamber 12 cools to 180° F. However, since fan control switch 26 continues the operation of motor 22, and associated fan 24 until the air within plenum chamber 12 reaches 80° F., the auxiliary air displacement unit of this invention will continue to operate until that air is cooled to 80° F. thereby continually moving via displacement air through duct work 16 and into the room air space. As a result, hot air is not wasted by sitting in the plenum chamber and the associated duct work until it cools. When the plenum chamber cools to 80° F., the fan control switch 26 senses this and shuts down the auxiliary displacement unit.

As a result of operation of this unit, the air space is constantly controlled temperaturewise, fuel savings is provided, better comfort is provided in the associated room space since the temperature remains constant, and importantly, gas and electrical costs are decreased significantly. In several experimental runs heating savings costs have been provided up to as much as 30% to 40% and electrical costs decreased by as much as 10%. Moreover, as can be seen the unit is very inexpensive and importantly may be simply mounted to conventional furnaces without any modifications whatsoever to those furnaces.

It is worthy to note that the auxiliary unit of this invention displaces warm and/or hot air from the plenum chamber before and after the normal heating cycle, gently moving that air through the heat ducts. This is a distinct function remote from the ordinary forcing of hot air through the plenum chamber by the high horsepower motors associated with conventional gas burning home furnaces. Use of the much smaller horsepower unit of this invention requires minimal electricity and in addition, does not continually force significant amounts of cooler air into the plenum chamber as is done by the fans of forced air blowers used with the furnace.

What is claimed is:

1. A method of maximizing available but unused heated air located in the plenum of furnaces in order to decrease fuel costs and maintain more constant temperatures in a room air space, said method comprising:

sensing the point at which air within the plenum chamber is sufficinetly warmed to provide valuable hot air but is still below the activation temperature of the furnace blower, displacing said warmed air into air flow paths for said room air space, and continuing said air displacement after said furnace blower has shut down, until the air within said plenum chamber reaches a predetermined displacement shut off temperature.

2. The method of claim 1 wherein an additional step comprises sensing when said air in said plenum chamber no longer has heat value, and using this point as the predetermined shut off temperature.

3. The method of claim 1 wherein the temperature at which the plenum is sufficiently warmed to provide valuable hot air but is still below the activation temperature of the furnace blower is within the range of 105° F. to 150° F.

4. The method of claim 2 wherein the temperature at which said air no longer has heat value for displacement into said room air space is 80° F. or less.

5. The method of claim 3 wherein the temperature is within the range of 70° F. to 80° F.

6. In combination with a hot air furnace employing a furnace blower, the improvement, comprising a mounting plate having front and back surfaces, a small horsepower low energy consumption motor having an air displacement fan, mounted on said front surface, an air deflector mounted to said back surface and in communication with said fan for directing displaced air into the air paths of a room space, and an air temperature sensitive switching means electrically connected to said motor and mounted to a surface of said plate for projection into a furnace plenum and for stopping and starting in response to sensed air temperatures within said furnace plenum.

7. The device of claim 6 wherein said air temperature switching means is a bimetallic switch, adapted to extend within a furnace plenum chamber.

8. The device of claim 6 wherein the horsepower of said motor is so greater than 1/10th as much as the horsepower of the motor for said furnace blower.

9. The device of claim 8 wherein said air displacement horsepower motor has a horsepower range of from about 1/50th of a horsepower to about 1/45th of a horsepower.

10. The device of claim 9 wherein said air deflector is of a configuration to displace air upwardly and outwardly from a furnace plenum chamber.

* * * * *